US011287199B1

(12) United States Patent
Cahill et al.

(10) Patent No.: US 11,287,199 B1
(45) Date of Patent: Mar. 29, 2022

(54) SLIDE RACKING ASSIST DEVICE FOR A PISTOL

(71) Applicant: TangoDown Inc., Tucson, AZ (US)

(72) Inventors: Jeffrey Matthew Cahill, Tucson, AZ (US); Daniel Michel, Diamond Bar, CA (US)

( * ) Notice: Subject to any disclaimer, the term of this patent is extended or adjusted under 35 U.S.C. 154(b) by 0 days.

(21) Appl. No.: 17/139,495

(22) Filed: Dec. 31, 2020

(51) Int. Cl.
*F41A 3/72* (2006.01)
*F41C 3/00* (2006.01)

(52) U.S. Cl.
CPC . *F41A 3/72* (2013.01); *F41C 3/00* (2013.01)

(58) Field of Classification Search
CPC .... F41A 3/72; F41A 19/47; F41C 3/00; F41C 27/00
See application file for complete search history.

(56) References Cited

U.S. PATENT DOCUMENTS 2,744,448 A * 5/1956 Allen ..... F41A 19/43 89/196
8,191,301 B2 * 6/2012 Hatfield ..... F41C 27/00 42/90
D724,689 S * 3/2015 Sui ..... D22/108
9,291,413 B1 * 3/2016 Viani ..... F41C 27/00
9,328,991 B2 * 5/2016 Gale ..... F41C 3/00
D761,374 S * 7/2016 Ellsworth ..... D22/108
9,500,439 B1 * 11/2016 Dietrich ..... F41C 27/00
9,523,545 B1 * 12/2016 Weller ..... F41C 33/0281
9,689,646 B1 * 6/2017 Story ..... F41G 11/003
9,733,043 B1 * 8/2017 Cohen ..... F41C 27/00
9,995,544 B1 * 6/2018 Akimov ..... F41C 3/00
10,274,272 B1 * 4/2019 Owensby ..... F41A 3/72
10,429,145 B2 * 10/2019 Savitsky ..... F41A 3/66
10,782,081 B2 * 9/2020 Porat ..... F41A 3/72
2011/0088539 A1 * 4/2011 Oz ..... F41A 3/72 89/1.4
2011/0154710 A1 * 6/2011 Hatfield ..... F41A 19/34 42/90
2012/0198744 A1 * 8/2012 Meller ..... F41C 3/00 42/90
2013/0111799 A1 * 5/2013 Lee ..... F41C 27/00 42/106
2014/0298703 A1 * 10/2014 Gale ..... F41C 27/00 42/71.02
2015/0121734 A1 * 5/2015 Kresser ..... F41C 3/00 42/16
2015/0354909 A1 * 12/2015 Tarantino ..... F41A 3/72 89/1.4
2016/0061562 A1 * 3/2016 Braun ..... F42C 3/00 42/111

(Continued)

*Primary Examiner* — Joshua E Freeman
(74) *Attorney, Agent, or Firm* — Crump Law P.C.

(57) ABSTRACT

A slide devise for facilitating grasping and pulling a pistol slide rearward during various pistol operations. The slide device facilitates pulling back the pistol slide utilizing relatively little force. The device includes an adaptor and a rack plate interconnected by a sliding dovetail joinery. The adaptor replaces the traditional slide cover plates on conventional striker fired pistols. The rack adaptor has an integral interface shoe, which seats within a complementary channel in the rack plate. The rack plate has a pair of opposed side protrusions or wings that are configured to fit or be engaged by the fingers or hand of the user, so as to allow the user to easily pull the pistol slide rearward.

5 Claims, 8 Drawing Sheets

(56) References Cited

U.S. PATENT DOCUMENTS

| | | | | |
|---|---|---|---|---|
| 2016/0102938 | A1* | 4/2016 | Sroufe | F41C 3/00<br>42/16 |
| 2017/0321977 | A1* | 11/2017 | Teitel | F41A 3/72 |
| 2018/0195819 | A1* | 7/2018 | Porat | F41A 3/72 |

* cited by examiner

SLIDE RACKING ASSIST DEVICE FOR A PISTOL

This invention relates to a device mounted to a pistol for facilitating the grasping and pulling of the pistol slide during various operations.

BACKGROUND AND SUMMARY OF THE INVENTION

Pistols include a slide which houses the firing mechanism and the barrel, through which the bullet is fired. During the recoil process, the slide slides backwards, along tracks in the top of the pistol's frame. When the slide is in its backwards position, a bullet from the magazine is urged into the barrel. The slide is then pulled forward by the recoil spring, thereby completing the loading process of the pistol, and at least partially cocking the firing mechanism. After firing the last bullet in the magazine, the pistol is reloaded by inserting a full magazine into the receiver and by manually pulling the slide rearwards, allowing a new round to be chambered. The pistol slide must also be pulled rearward to eject a chambered round during unloading and to clear certain malfunctions. Consequently, manually pulling or "racking" a pistol slide is a frequent operation for pistols.

The present invention relates to a slide device for facilitating grasping and pulling a pistol slide rearward during various pistol operations. The slide device or "racker" facilitates pulling back the pistol slide utilizing relatively little force. The racker includes an adaptor and a rack plate interconnected by a sliding dovetail joinery. The adaptor replaces the traditional slide cover plates on conventional striker fired pistols. The rack adaptor has an integral interface shoe, which seats within a complementary channel in the rack plate. The rack plate has a pair of opposed side protrusions or wings that are configured to fit or be engaged by the fingers or hand of the user, so as to allow the user to easily pull the slide rearward.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangement of system and method components. The drawings are only for purposes of illustrating exemplary embodiments and are not to be construed as limiting the invention. The drawings illustrate the present invention, in which.

DESCRIPTION OF THE PREFERRED EMBODIMENT

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical, structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
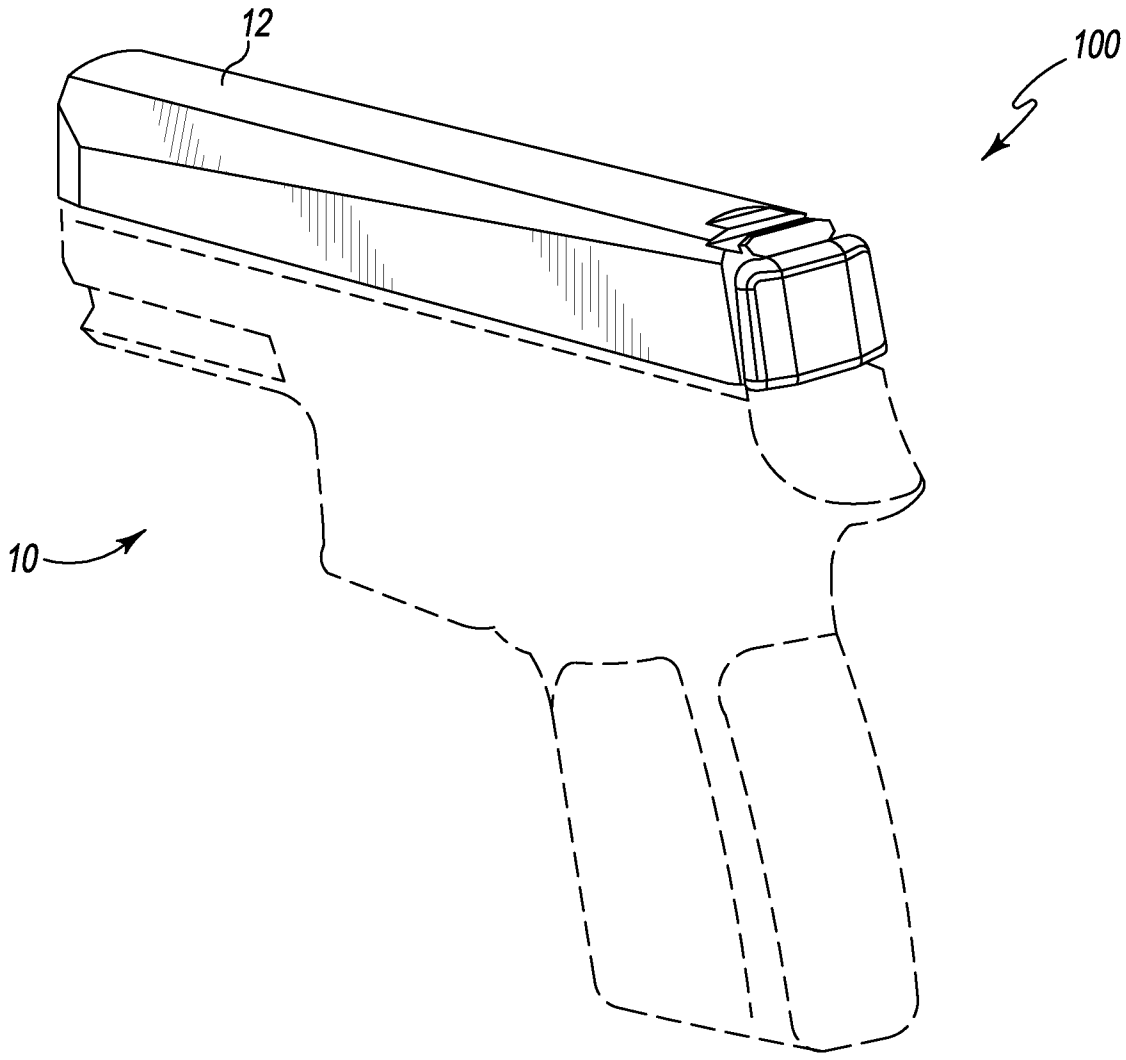
FIG. 1 is a rear perspective view of a generic pistol showing an exemplary embodiment of the slide device of this invention mounted to the pistol slide.
Figure 2:
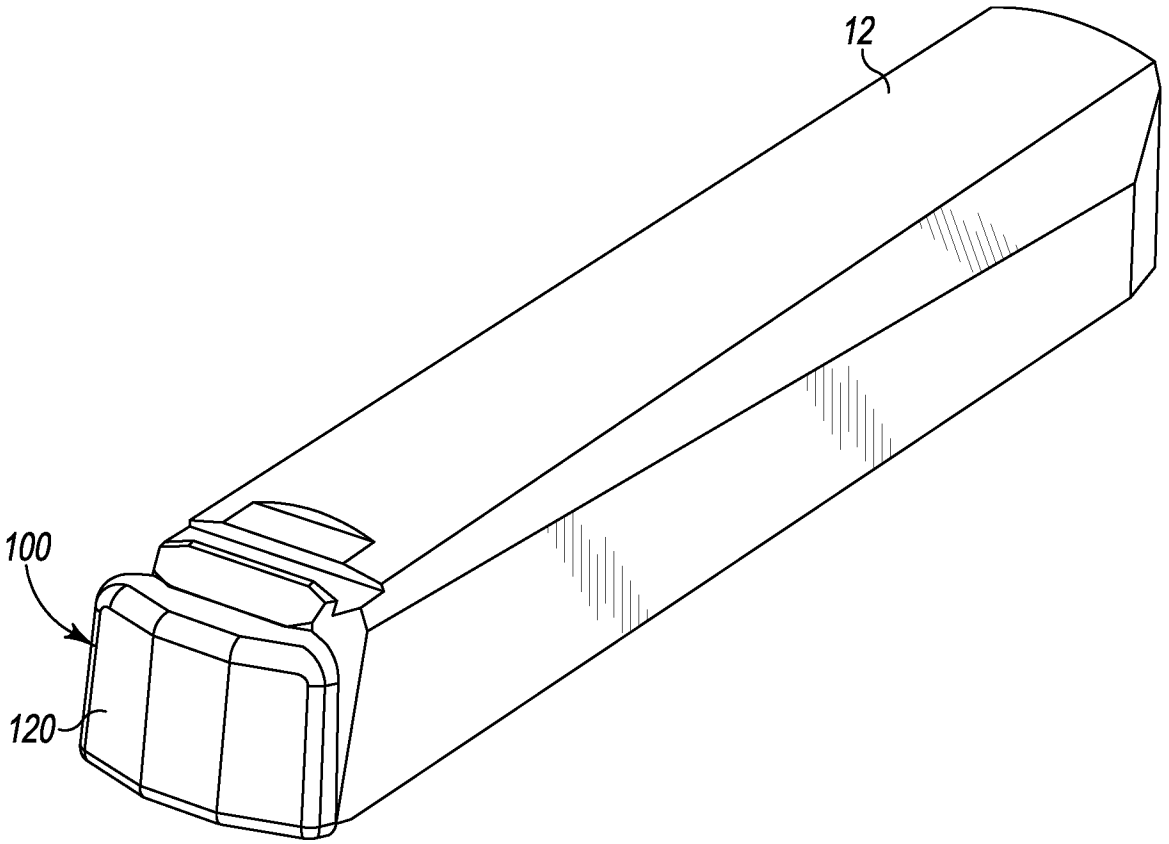
FIG. 2 is a rear perspective view of the slide device and pistol slide of FIG. 1.
Figure 3:
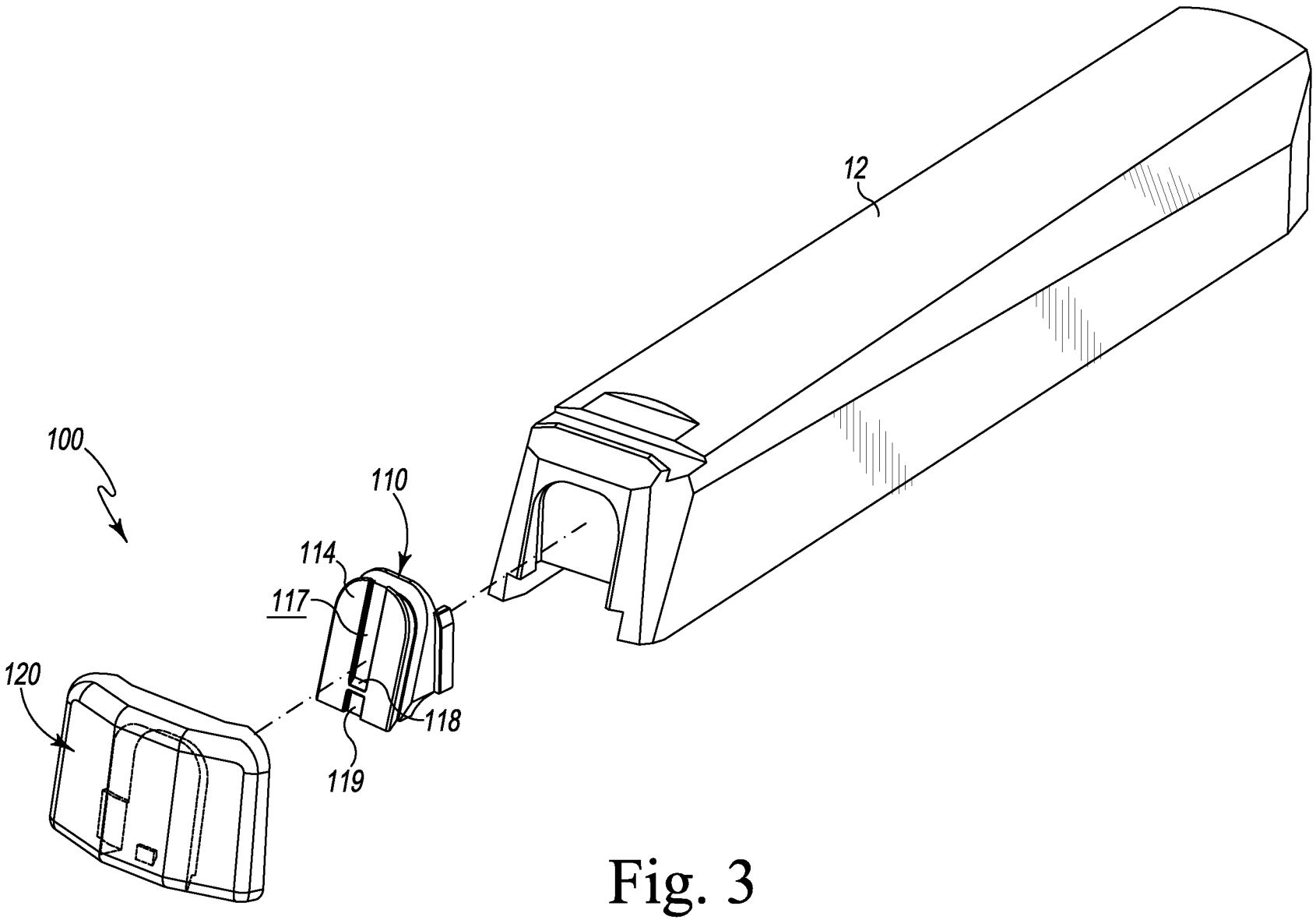
FIG. 3 is an exploded rear perspective view of the slide device and pistol slide of FIG. 2.
Figure 4:
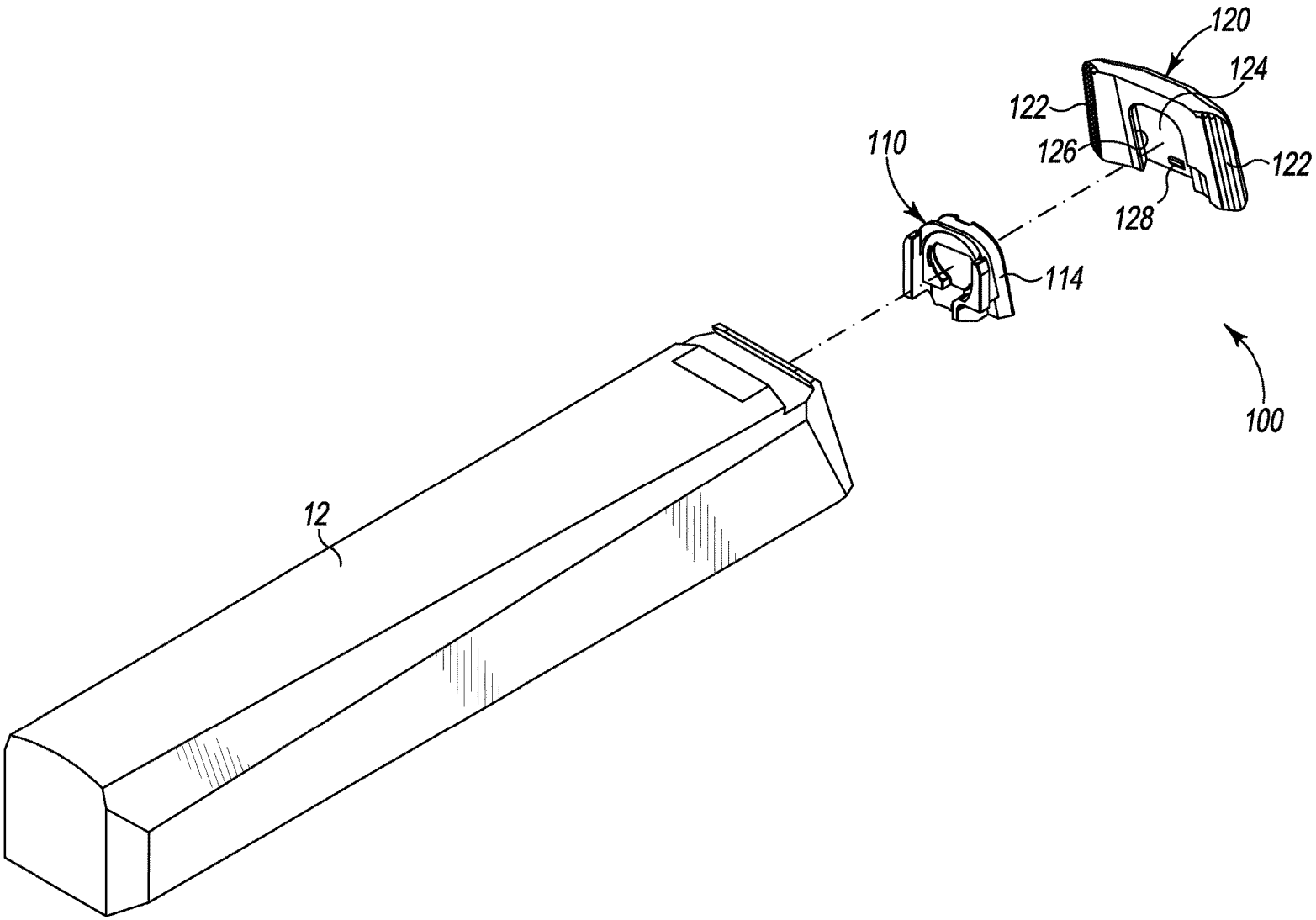
FIG. 4 is an exploded front perspective view of the slide device and pistol slide of FIG. 2.
Figure 5:
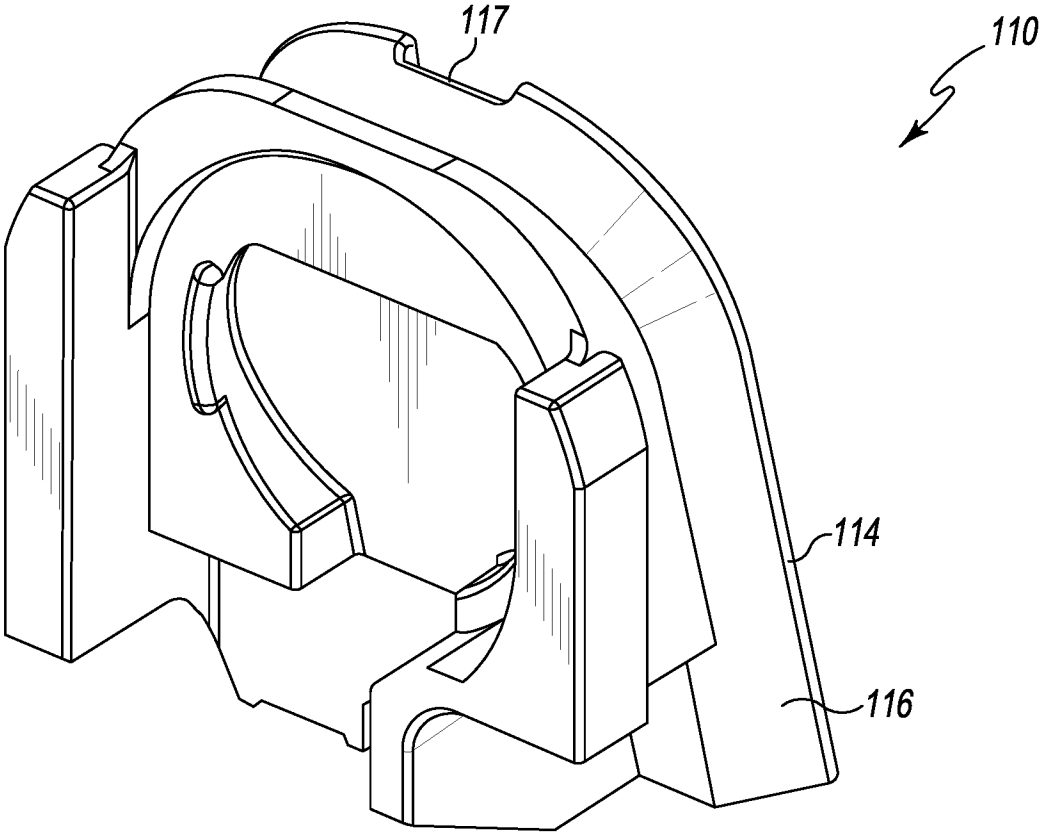
FIG. 5 is a front perspective view of the adaptor of the slide device of FIG. 1.
Figure 6:
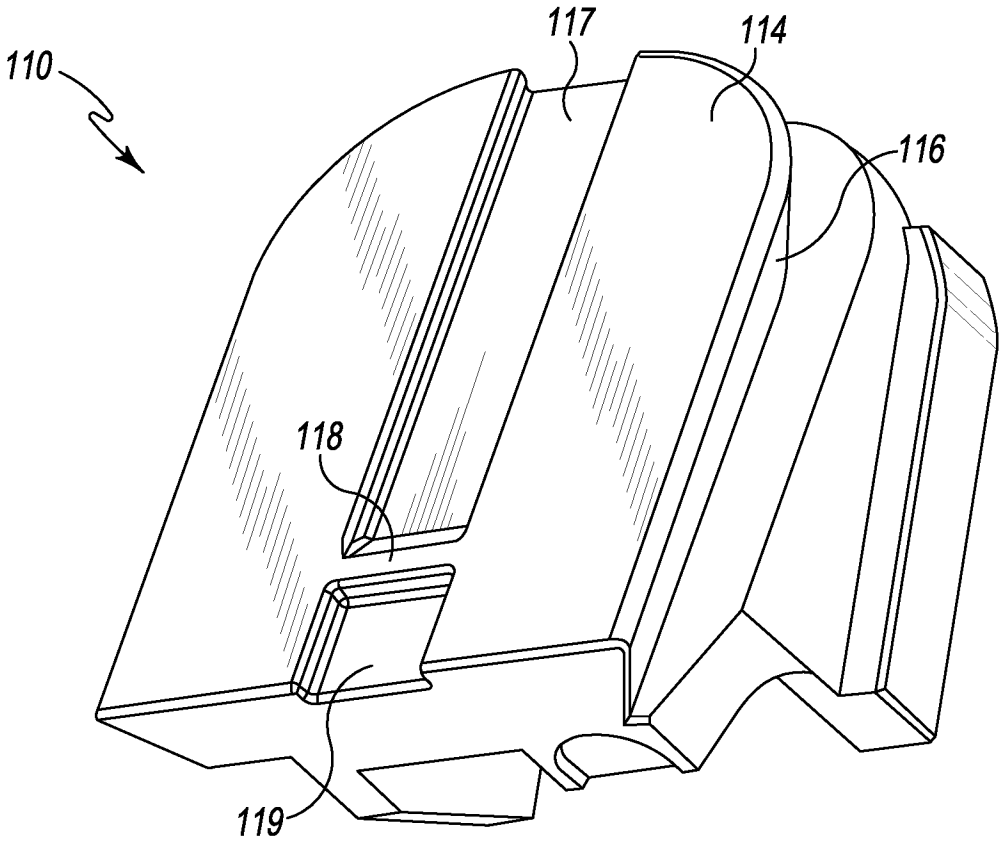
FIG. 6 is a rear perspective view of the adaptor of the slide device of FIG. 1.
Figure 7:
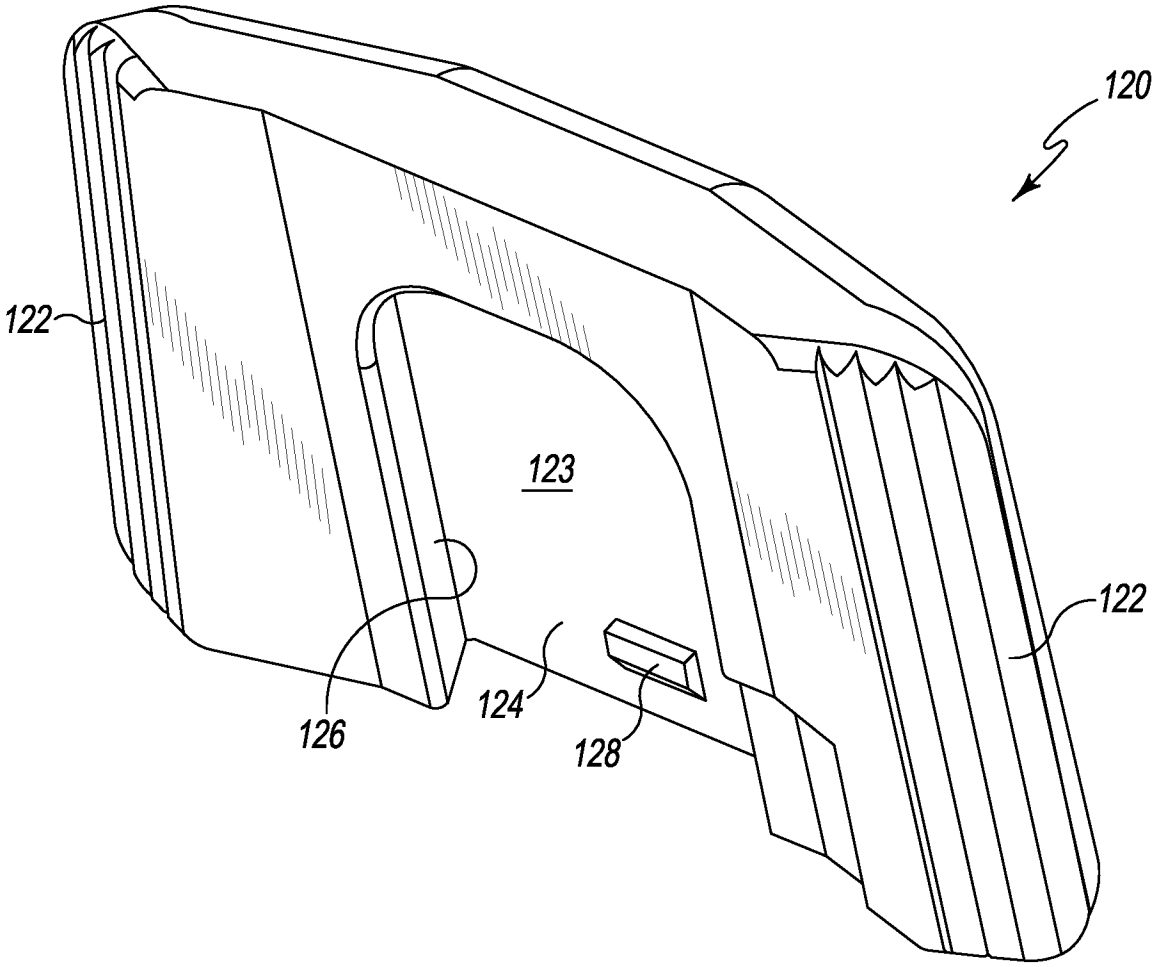
FIG. 7 is a front perspective view of the rack plate of the slide device of FIG. 1.
Figure 8:
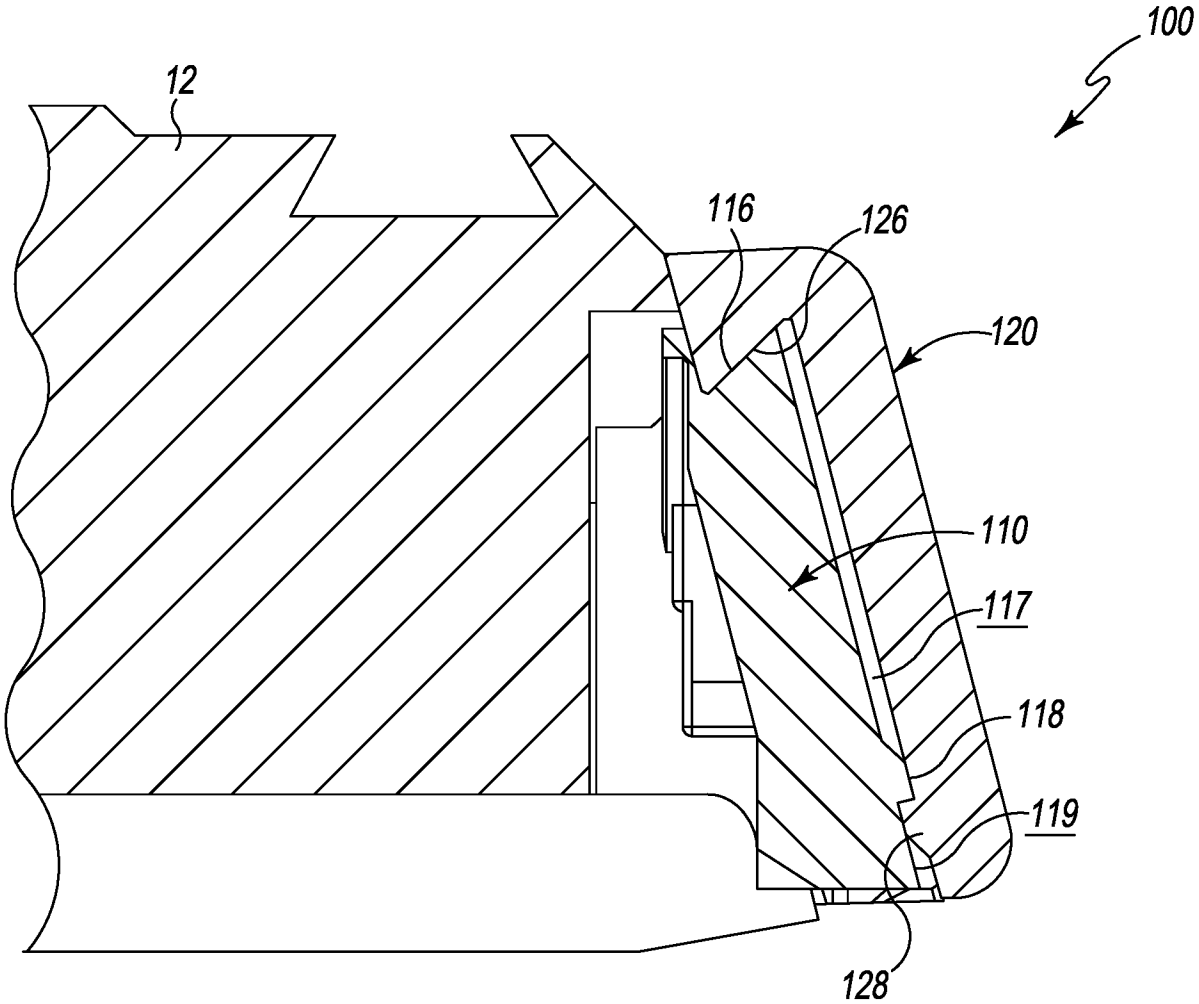
FIG. 8 is a side cross-sectional view of the rack plate of the slide device of FIG. 1.

Referring now to the drawings, FIGS. 1-8 illustrate an exemplary embodiment of the slide racking assist device of this invention, which is designated generally as reference numeral 100. For simplicity of explanation, slide device or "racker" 100 is illustrated used on a generic pistol 10, which includes a reciprocating slide 12. Racker 100 facilitates pulling back the pistol slide 12 utilizing relatively little force for reloading or unloading the pistol. Racker 100 has a pair of opposed side protrusions or wings that are configured to fit or be engaged by the fingers or hand of the user, so as to allow the user to easily pull the slide back. Racker 100 replaces the slide cover plates (not shown) on conventional striker fired pistols and is generally configured and adapted for each specific model of pistol. Slide cover plates used on conventional striker fired pistols enclose the rear of the pistol slide and are well known in the firearms industry. Racker 100 can be adapted for use with any semi-automatic pistol replacing the conventional rear slide cover plate mounted to the rear of the slide.

As shown, racker 100 uses a two piece design and includes a cover plate adaptor 110 and a detachable rack plate 120. Adaptor 110 and rack plate 120 are interconnected using a sliding dovetail interface or similar joinery. Adaptor 110 and rack plate 120 are ideally formed or molded from a suitable thermoplastic polymer, however, one or the other may be cast or machined of a suitable metal.

Adaptor 10 is configured to affix directly within the open end of slide 12 and functions as a conventional slide cover plate, as well as, an interconnection element between rack plate 120 and slide 12. Adaptor 110 typically affixes to the slide 12 in the same way as the conventional rear cover plate. Adaptor 110 can be fitted to slide 12 without having to make any changes in the original slide or pistol. For example, if the rear wall of slide 12 includes a groove for receiving a rear cover plate, adaptor 110 would include tracks or facets complementary to the slide groove for mounting the adaptor to the slide. This way, mounting the slide grip on the pistol can be carried out by simply replacing the original rear cover plate of the slide, without having to drill holes in the slide, or to weld racker 100 to the slide. Adaptor 110 has a proximal end configured to seat within the rear opening of slide 12 and a distal end that extends past the rear of the slide. The distal end of rack adaptor 110 has an integral interface shoe 114. Interface shoe 114 is a flat tombstone shaped feature that generally lies perpendicular to the longitudinal axis of slide 12. Interface shoe 114 has a beveled peripheral edge 116. The distal face of interface shoe 114 has a vertical (relative to the top of slide 12) recessed slot 117 and a recess pocket 119 separated by a horizontal ridge 118.

Rack plate 120 is a relatively flat rectangular member having two opposed side wings 122 that are configured to protrude laterally beyond the sidewalls of slide 12 when racker 100 is fitted to the slide. Each wing 122 has a forward facing gripping surface, preferably including serrations, ridges or texturing to facilitate gripping of racker 100 while pulling slide 12 rearward. The proximal or interior face of rack plate 120 has a complementary tombstone shaped channel 123 for receiving interface shoe 112 of adaptor 110. Channel 123 is defined by a back wall 124 and an inset beveled rim 126. Interface shoe 114 seats within channel 123 with beveled edge 116 mating against bevel rim 126. The configuration of interface shoe 114 and channel 123 provide a sliding dovetail joinery to hold rack plate 120 to adaptor 110. Rack plate 120 also includes a rectangular protrusion or pintle 128 that extends outward from back wall 122. Pintle 128 provides a locking mechanism to secure the dovetail joinery of rack plate 120 to adaptor 110. Pintle 128 extend into slot 117 sliding along its length as interface shoe 114 is seated into channel 123, until snapping over ridge 118 and restrictively seating within pocket 119. Rack plate 120 is held in place to adaptor 110 by pintle 128 seating within pocket 119, which prevents the rack plate from disengaging from interface shoe 114 and adaptor 110.

It should be apparent from the foregoing that an invention having significant advantages has been provided. While the invention is shown in only a few of its forms, it is not just limited but is susceptible to various changes and modifications without departing from the spirit thereof. The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

We claim:

1. A slide racking assist device for a pistol having a reciprocating slide with rear end thereof, the device comprises:

an adaptor part mountable to the slide distal end; and a rack plate detachably mounted to the adaptor part, the adaptor part having a proximal end thereof configured to seat within the rear end of the slide and a distal end thereof, the adaptor part having an interface shoe extending from the distal end thereof, the rack plate having a channel defined therein for receiving the interface shoe to hold the rack plate against the adaptor part, the rack plate includes a pintle protruding from the channel, the interface shoe has an elongated slot and a recessed pocket defined therein for receiving the pintle, the pintle restrictively seated within the pocket to lock the rack plate in position against the adaptor part.

2. The device of claim 1 wherein the rack plate has a pair of opposed wing parts extending laterally from the rack plate.

3. The device of claim 2 wherein each of the opposed wing parts has a contact surface to facilitate gripping of device while manually pulling the slide.

4. The device of claim 1 wherein the interface shoe has a beveled peripheral edge, the channel defined in part by a beveled peripheral rim, the peripheral edge of the interface shoe engaged against the peripheral rim of the channel to hold the rack plate against the adaptor part.

5. A slide racking assist device for a pistol having a reciprocating slide with rear end thereof, the device comprises:

an adaptor part mountable to the slide distal end, the adaptor part having a proximal end thereof configured to seat within the rear end of the slide and a distal end thereof, the adaptor part including an interface shoe extending from the distal end thereof, the interface shoe has a beveled peripheral edge; and a rack plate detachably mounted to the adaptor part, the rack plate having a channel defined therein for receiving the interface shoe to hold the rack plate against the adaptor part, the rack plate has a pair of opposed wing parts extending laterally from the rack plate, each of the opposed wing parts has a contact surface to facilitate gripping of device while manually pulling the slide, the channel defined in part by a beveled peripheral rim, the rack plate includes a pintle protruding from the channel, the interface shoe has an elongated slot and a recessed pocket defined therein for receiving the pintle, the peripheral edge of the interface shoe engaged against the peripheral rim of the channel to hold the rack plate against the adaptor part, the pintle restrictively seated within the pocket to lock the rack plate in position against the adaptor part.

* * * * *